US007229326B1

(12) United States Patent
Griffey

(10) Patent No.: US 7,229,326 B1
(45) Date of Patent: Jun. 12, 2007

(54) ELECTRODE CONNECTION SYSTEM

(76) Inventor: Eric C. Griffey, 14 Golder St., Lewiston, ME (US) 04240

( * ) Notice: Subject to any disclaimer, the term of this patent is extended or adjusted under 35 U.S.C. 154(b) by 0 days.

(21) Appl. No.: 11/466,833

(22) Filed: Aug. 24, 2006

(51) Int. Cl.
*H01R 11/22* (2006.01)

(52) U.S. Cl. ..... 439/829

(58) Field of Classification Search ..... 439/829, 439/282, 860, 909, 835, 859, 759, 840, 660, 439/609
See application file for complete search history.

(56) References Cited

U.S. PATENT DOCUMENTS 1,701,387 A * 2/1929 Rabezzana ..... 439/429
3,606,681 A * 9/1971 Woodson ..... 30/133
4,390,223 A * 6/1983 Zenkich ..... 439/592
6,487,430 B1 * 11/2002 Henderson et al. ..... 600/394

* cited by examiner

*Primary Examiner*—Phuong Dinh

(74) *Attorney, Agent, or Firm*—Verrill Dana, LLP; Chris A. Caseiro; Brian J. Libby

(57) ABSTRACT

An electrode connection system for connecting an electrode to a substrate, such as to human skin. The system includes a first connecting member and a second connecting member, wherein the first connecting member is connectable to an electrode, and the second connecting member is connectable to the substrate, either directly or through an attachment device, such as a bandage. In a first embodiment of the present invention, the first connecting member and the second connecting member may be reversibly and securely connected to each other by inserting a loop of one of the connecting members into a retaining groove of the other connecting member. In a second embodiment, the first and second connecting members may be reversibly and securely connected to each other by inserting a nub of one of the connecting members into a retaining basin of a locking groove of the other connecting member.

7 Claims, 10 Drawing Sheets

ELECTRODE CONNECTION SYSTEM

BACKGROUND OF THE INVENTION

1. Field of the Invention

The present invention relates to electrodes. More particularly, the present invention relates to systems for reversibly attaching an electrode. The present invention is an electrode connection system.

2. Description of the Prior Art

Electrodes are routinely used in medicine and in scientific research. For example, electrodes are used as part of electrocardiograph machines, which monitor heart rhythm, and electroencephalograph machines, which monitor brain activity. For these machines to function properly, their electrodes must be held in contact with the skin throughout the monitoring process. Further, their electrodes must not move from the position on the skin where they were originally attached by the physician or scientist. This is important because whenever an electrode is improperly attached to the skin, becomes wholly or partially detached from the skin, or moves about the skin during the monitoring process, any data generated by the machine thereafter likely will be inaccurate, and therefore, unreliable. Unreliable data obtained in the course of treating of a human patient may cause the patient's condition to be misdiagnosed. Misdiagnosis, in turn, can cause the physician to perform unnecessary steps, such as prescribing medicine or undertaking surgery, which can harm the patient. Alternatively, misdiagnosis can lead the physician to conclude further treatment is not needed, when further treatment actually is needed, and perhaps is even needed to save the patient's life.

Since it is important that electrodes be correctly and securely attached to a patient's skin, it is unfortunate that existing means for attaching electrodes are not optimally designed to achieve this purpose. One existing device for attaching an electrode to skin involves using a device having two parts. One part attaches to the skin, and the other part, which is coupled to an electrode, connects to the first part, thereby connecting the electrode to the skin. Existing electrode connection devices of this kind are not optimal because it is difficult to connect and disconnect their two parts when one of the parts is attached to skin. For example, some of these connection devices contain several movable parts, each of which must be finely manipulated in concert to achieve connection or disconnection. Having to make such fine and precisely timed manipulations can be frustrating to the user, namely because the user often will have to make several attempts before successfully connecting or disconnecting the parts. Further, having to make fine and precise manipulations makes it more likely that the user will only partially connect the parts.

Some existing two-part electrode connecting devices are not optimal because they do not always enable a secure connection to be made, thereby increasing the likelihood that the connecting parts will accidentally disconnect. This problem is likely to arise when a patient is being monitored for an extended period of time, and is especially likely to occur when a patient is sleeping, for example, when tossing and turning by the patient often cause tension between the two parts. Whenever these parts accidentally disconnect, a health care provider must physically reconnect the parts. This practice can be disruptive both to the nurse and the patient, especially when the nurse is busy and is needed to perform other duties and the patient needs to rest as part of the recovery process. It can also increase the overall healthcare cost per patient.

As a specific example of an existing electrode connection device having suboptimal connectivity of parts, in one particular device the device includes a nipple-like member, which is attachable to skin, and an electrode wire connected to a coupling device such as a ring-like member or the clip, wherein the ring-like member or a clip is placeable around a smooth and slight indentation in the wall of the nipple-like member. In this arrangement, the ring-like member may be slid over the top of the nipple-like member and rested within its indentation, or the clip may be clipped to the nipple-like member. The problem with the design of this particular device is that the indentation does not have a lip or other like-component for preventing the ring-like member from slipping away from the nipple-like member. Therefore, the connection made between the ring-like member or clip and the nipple-like member is not a particular secure one even when the ring-like member or clip and the nipple-like member are clean and dry. Worse, when sweat and oil of the patient infiltrate the connection between the ring-like member or clip and the nipple-like member, which they are prone to do, the ring-like member or clip is even more likely to accidentally become disengaged from the nipple-like member.

What is needed therefore is a system for securely attaching an electrode to skin to prevent it from moving about the skin or from becoming detached from the skin during normal use, such as when it collects sweat and oil from a patient and when it is attached to a sleeping patient. Further, what is needed is an electrode connection system that is easy to use. In particular, it should be easy for users of the electrode connection system to quickly swap electrode wires when desired.

SUMMARY OF THE INVENTION

It is an object of the present invention to provide an electrode connection system which allows an electrode wire to be easily and securely attached to and removed from an electrode which is connectable to skin. The system of the present invention includes two connecting parts, a first connecting member and a second connecting member, which are used for this purpose. An optional attachment device may be used to securely attach the first connecting member to the skin. The second connecting member, which is attachable to an electrode wire, is reversibly connectable to the first connecting member.

In a first embodiment of the present invention, one of the connecting members includes a changeable and flexible loop and a loop flexing device. The loop flexing device includes a press pad which causes the shape of the loop to change conformation by causing the loop to be pressed against a loop resistance member whenever the press pad is pressed. The other connecting member has a retaining groove into which the loop may be inserted and held. When the loop is held in the retaining groove, the two connecting members are securely connected to each another, and therefore, the connecting member having the retaining groove is securely held to the skin. Their connection cannot be dislodged without manipulation in a specific manner not prone to accidental occurrence. The two connecting members may be released from each other by causing the push pad to force the loop to change shape or position sufficiently to cause it to slip out of the groove for removal from the other connecting member.

In a second embodiment of the present invention, one of the connecting members includes a nub and the other connecting member includes a locking groove into which the nub may be inserted, and moved, with minimal effort and manipulation. The locking groove includes a nub retaining basin which may be used to securely hold the nub. When the nub is held in the retaining basin, the two connecting members are securely connected to each another, and therefore, the electrode is securely held to the skin. Their connection cannot be dislodged without manipulation in a specific manner not prone to accidental occurrence. The two connecting members may be released from each other by sliding the nub from the nub retaining basin and out of the locking groove.

It is another object of the present invention to provide an electrode system including only one connecting member, either the first connecting member or the second connecting, which is connectable to an existing connecting member. For one example, the present invention is a single connecting member having, among other components, a flexible loop connectable to an electrode wire, and the single connecting member is connectable to an existing nipple-like member. In another example, the present invention is a single connecting member arranged to connect with an existing coupling device, such as a ring-like member or clip.

The details of one or more examples related to the invention are set forth in the accompanying drawings and the description below. Other features, objects, and advantages of the invention will be apparent from the following description, the accompanying drawings and the appended claims.

DETAILED DESCRIPTION OF THE PREFERRED EMBODIMENT

Figure 1:
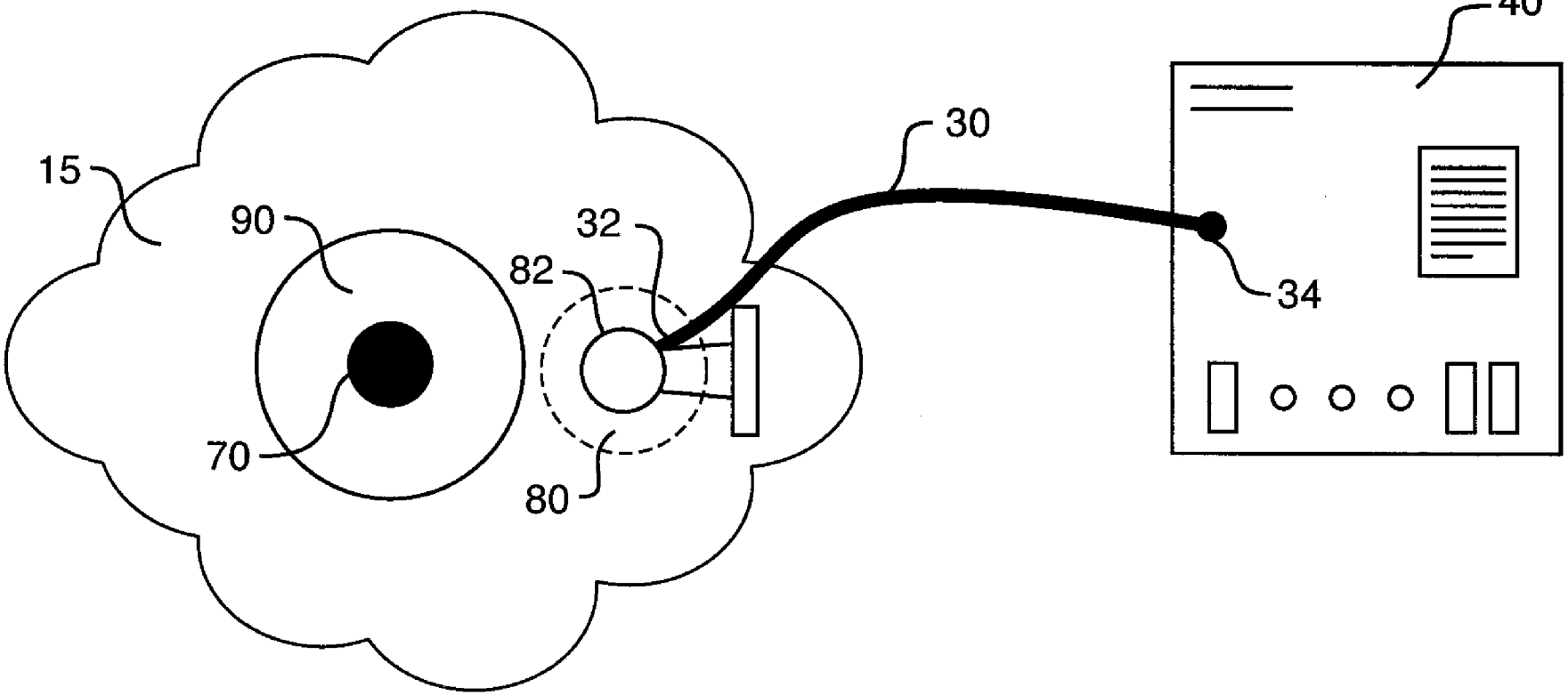
FIG. 1 is a top view of the electrode connection system of a first arrangement of a first embodiment of the present invention showing a first connecting member attached to a substrate and a second connecting member (a cap of the second connecting member is shown in phantom) coupled to an electrode wire, wherein the connecting members are not connected to each other.

The present invention is an electrode connection system which may be used to securely attach an electrode to a substrate, such as skin, for the purpose of receiving electrical signals from the substrate and transmitting those signals to another device.

A first arrangement of a first embodiment of the present invention of an electrode connection system 10, shown in FIGS. 1-6, includes a first connecting member 70, a second connecting member 80 connected to an electrode wire 30, and an optional substrate attachment device 90. The first connecting member 70, which is an electrode, is attachable to a substrate 15 by way of the substrate attachment device 90. The order in which all connection and attachment steps (regarding all arrangements and embodiments of the invention described herein) are performed is unimportant, and therefore they may be performed in any order.

Figure 2:
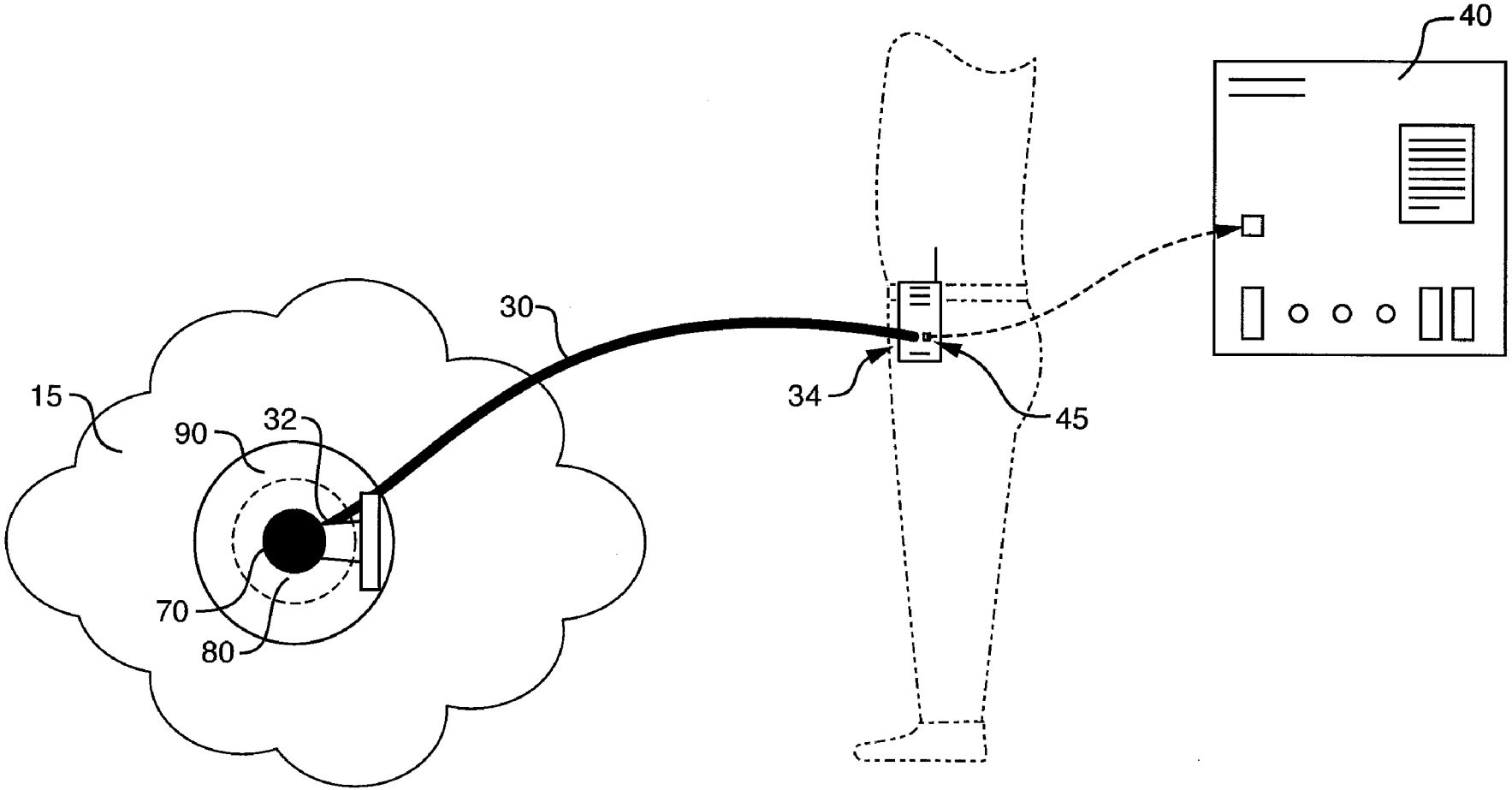
FIG. 2 is a top view of the electrode connection system of the first arrangement of the first embodiment of the present invention showing the first connecting member attached to the substrate and the second connecting member (a cap of the second connecting member is shown in phantom) coupled to an electrode wire, wherein the connecting members are connected to each other, and therefore, wherein the first connecting member is electrically connected to the substrate.

The electrode wire 30 has a first end 32 and a second end 34. First end 32 is connected to the second connecting member 80 at a loop 82. Second end 34 is connectable to a monitoring device 40, as shown in FIG. 1. Alternatively, as shown in FIG. 2, the second end 34 is connectable to an optional transmitting device 45, which is capable of transmitting electrical signals or information to the monitoring device 40. The monitoring device 40 and the optional transmitting device 45 are capable of receiving electrical signals from the electrode wire 30. The monitoring device 40 may be, but is not limited to being, an electrocardiograph machine or an electroencephalograph machine. When the transmitting device 45 is included, the transmitting device 45 is capable of wirelessly signaling the monitoring device 40. Therefore, the transmitting device 45 may be worn, if desired, on the person of the professional using the system 10 while a patient is being monitored via the monitoring device 40. As another example, the transmitting device 45 may be attached to an object near the patient, such as the patient's bed or an intravenous dispenser.

The first connecting member 70 and the second connecting member 80 are shown in FIG. 1 as being disconnected from each other, and the first connecting member 70 and the second connecting member 80 are shown in FIG. 2 as being connected to each other. In both FIG. 1 and FIG. 2, the second connecting member 80 is shown as being attached to the substrate 15. Although the order of performing the steps of connecting the first connecting member 70 to the second connecting member 80 and attaching the first connecting member 70 to the substrate 15 is not important, the first connecting member 70 and the second connecting member 80 are designed to be easily connectable to, and disconnectable from, each other when the first connecting member 70 is already attached to the substrate 15. However, it is not essential that this order be followed in all instances.

Figure 4:
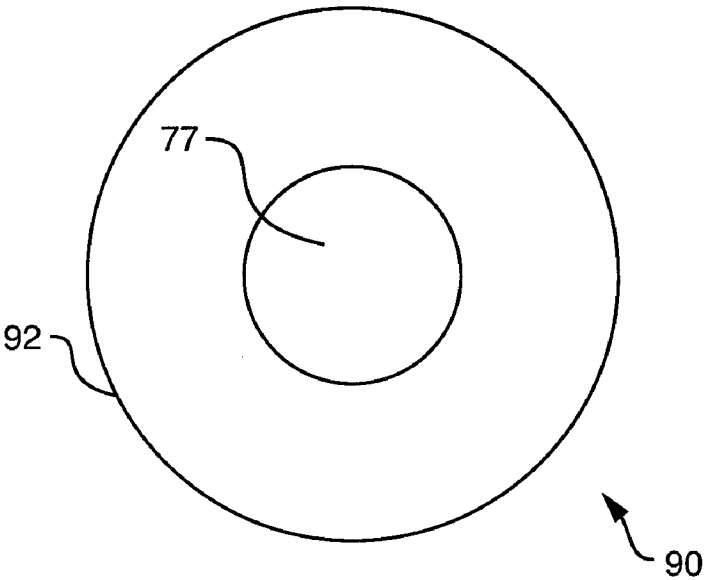
FIG. 4 is a bottom view of the first connecting member and the substrate attachment device of the electrode connection system in the first arrangement of the first embodiment of the present invention.
Figure 3:
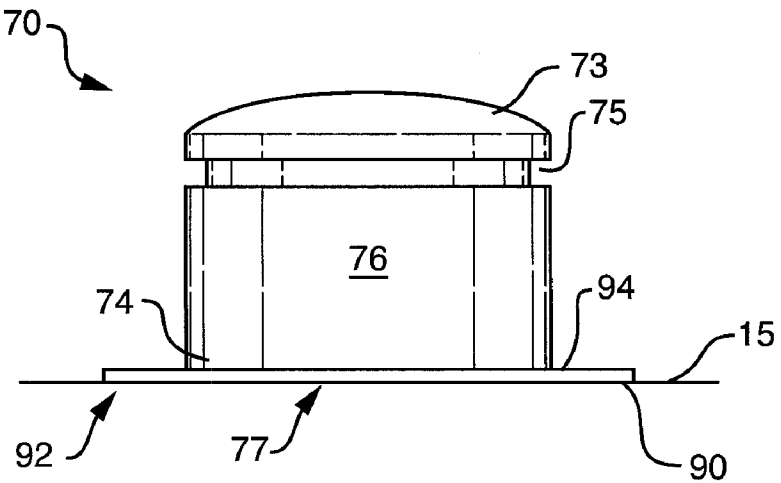
FIG. 3 is a side view of the first connecting member and a substrate attachment device of the electrode connection system in the first arrangement of the first embodiment of the present invention.

As shown in FIGS. 3 and 4, the first connecting member 70 joins to the substrate attachment device 90, which may be permanently or releasably attached thereto. The substrate attachment device 90 includes attachment surface 92 and non-attachment surface 94. The first connecting member 70 is a body having a first end 73 and a second end 74. The member 70 includes a retaining groove 75 which is recessed in outer surface 76 and which runs around all or a portion of the circumference of outer surface 76 spaced between the first end 73 and the second end 74. A substrate contact face 77 of the member 70 is located at second end 74. The member 70 protrudes through the substrate attachment device 90 such that substrate contact face 77 is essentially flush with attachment surface 92, and the first end 73 is spaced away from non-attachment surface 94. Alternatively, the member 70 may rest entirely on the substrate attachment device 90 and not protrude therethrough, provided there is minimal loss of electrical connectivity with the substrate 15. In another alternative, the member 70 is not joined to a substrate attachment device 90, but is instead attached to the substrate 15 by some other means. For example, the substrate contact face 77 may be coated with an adhesive, and the adhesive may be used to attach the member 70 to the substrate 15.

Attachment surface 92 of the substrate attachment device 90 includes means for releasably attaching the substrate attachment device 90 and the member 70 to the substrate 15. For example, the attachment surface 92 may be coated with an adhesive. Attachment of attachment surface 92 to the substrate 15 effectively contacts the substrate contact face 77 of the member 70 to the substrate 15, thereby allowing electrical connectivity between the substrate 15 and the member 70. To enhance this connectivity, substrate contact face 77 may be coated with a conductivity agent, such as a conductivity gel, before the substrate attachment device 90 is attached to the substrate 15.

Figure 5:
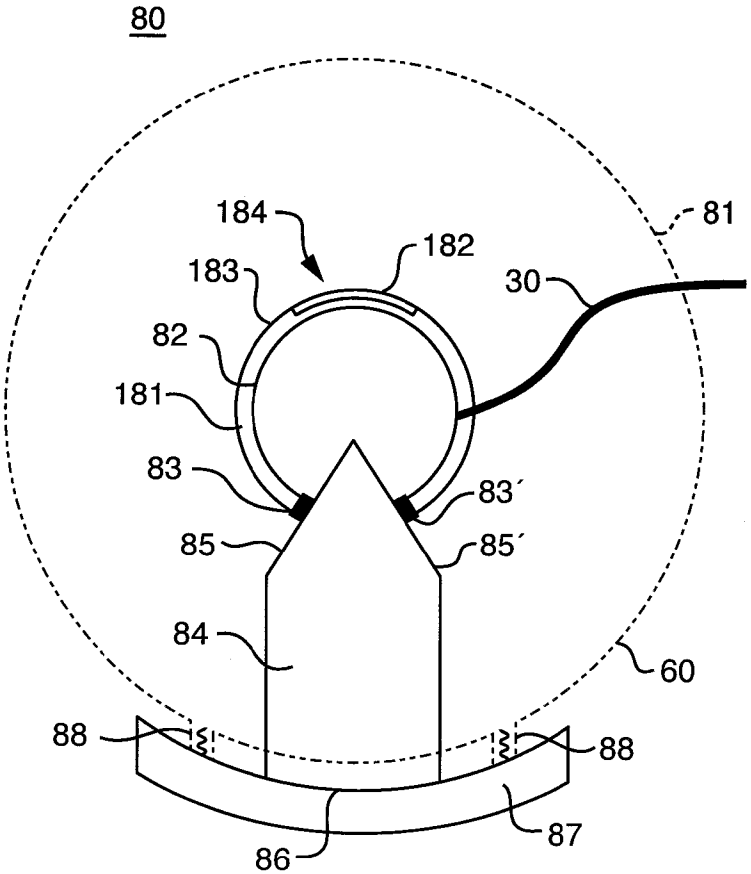
FIG. 5 is a bottom view of the second connecting member of the electrode connection system in the first arrangement of the first embodiment of the present invention.

As shown in FIG. 5, the second connecting member 80 includes a cap 81, the loop 82, and a loop flexing device. The loop flexing device includes a movable body 84, a press pad 87, one or more springs 88, recessed area 181 and loop resistance member 182. The cap 81 covers the loop 82. The loop 82 is located within recessed area 181 of the cap 81. The loop 82 is attached to the body 84. As an example of how the loop 82 may be attached to the body 84, the loop 82 may have two crimped ends 83/83', and one of the crimped ends 83 may be attached to one of two sloped side walls 85/85' of the body 84, and the other crimped end 83 may be attached to the other sloped side wall 85'. The press pad 87 is attached to wall 86 of the body 84. The spring or springs 88 are connected to side wall 89 of the cap 81 and to the press pad 87. The loop resistance member 182 is connected to inner wall 183 of recessed area 181 essentially at position 184.

Figure 6:
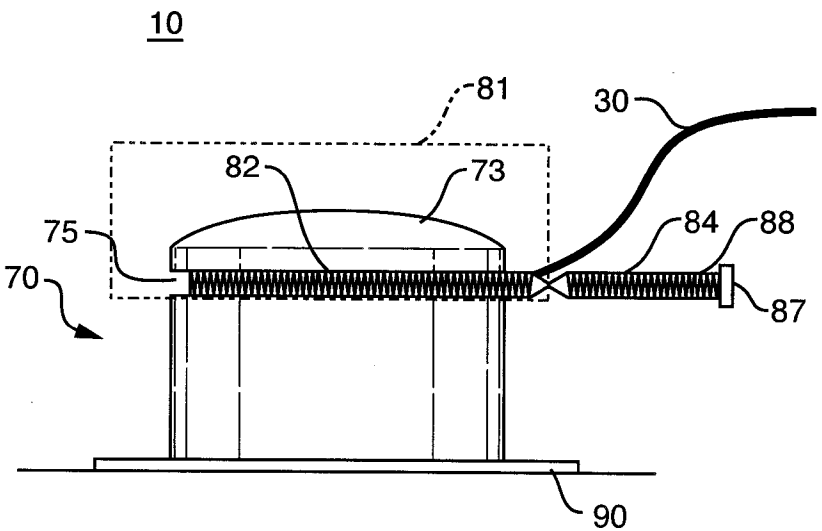
FIG. 6 is a side view of the first connecting member of the electrode connection system connected to the second connecting member in the first arrangement of the first embodiment of the present invention showing a cap of the second connecting member in phantom.

Connection of the first connecting member 70 and the second connecting member 80 involves inserting the loop 82 into the retaining groove 75 of the first connecting member 70 as shown in FIG. 6. This insertion may be partially effected by using the press pad 87. When no pressure is applied to the press pad 87, the loop 82 remains in a "resting" state. When the press pad 87 is pressed toward the cap 81, the body 84 is moved toward the center of the loop 82 and is pressed against the loop resistance member 182. Whenever the loop 82 is pressed against the loop resistance member 182, the loop 82 changes shape from its resting state to a "widened" state. Subsequent release of the press pad 87 causes the loop 82 to return to its resting state. Retaining the loop 82 within the retaining groove 75 therefore involves forcing the loop 82 to its widened state by pressing the press pad 87, placing the loop 82 over the top of the member 70 at first end 73, inserting the loop 82 within the groove 75, and fully releasing the press pad 87 to return the loop 82 to its resting state. When the loop 82 is secured in its resting state within the groove 75, the loop 82 cannot be removed from the groove 75 without first bringing the loop 82 to its widened state by taking the affirmative steps of pushing the press pad 87 in and moving the loop 82 out of the groove 75.

Alternatively, instead of being connected to the second connecting member 80, the first connecting member 70 may be connected to the coupling device used in existing electrode connection systems. Further, instead of being connected to the first connecting member 70, the second member 80 may be connected to any existing compatible connecting member used in the art of electrode connection systems. For example, the loop 82 may be connected to the nipple-like member used in existing electrode connection systems.

Since the electrode connection system 10 is used to receive electrical signals from the substrate 15 and transmit those signals ultimately to the monitoring device 40, all components of the system through which these signals must be transmitted must be made of a conductive material or include a conductive material. In particular, the electrode wire 30, the loop 82, and at least part of the member 70 are preferably made from such a material. Further, the loop 82 is formed from a material which not only is conductive, but it must include a flexible characteristic. Conductive materials which may be used to form the electrode wire 30 and the member 70 include, but are not limited to being, aluminum, copper, silver, tungsten, molybdenum, alloys including these metals, conductive polymers, and conductive ceramics. The listed metals and alloy thereof may be used to form the loop 82. The loop 82, however, is not limited to being formed from these metals or their alloys.

Figure 7:
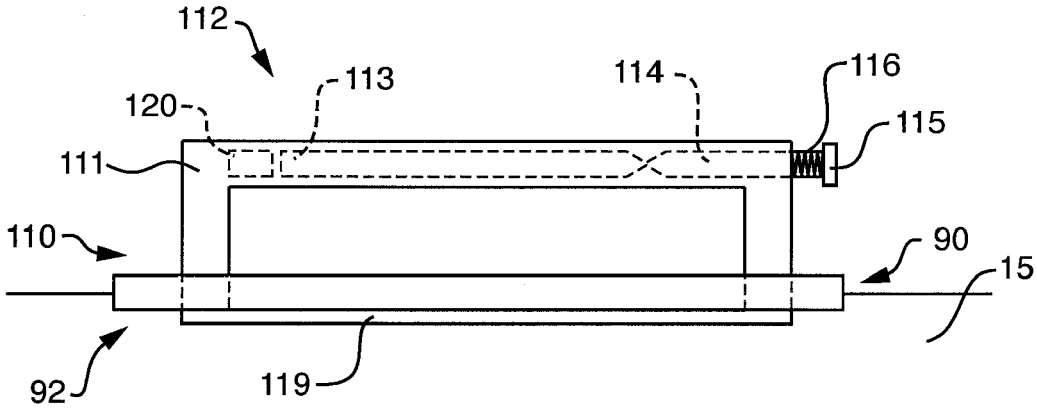
FIG. 7 is a side view of the electrode connection system of a second arrangement of the first embodiment of the present invention showing the first connecting member attached to the substrate.
Figure 8:
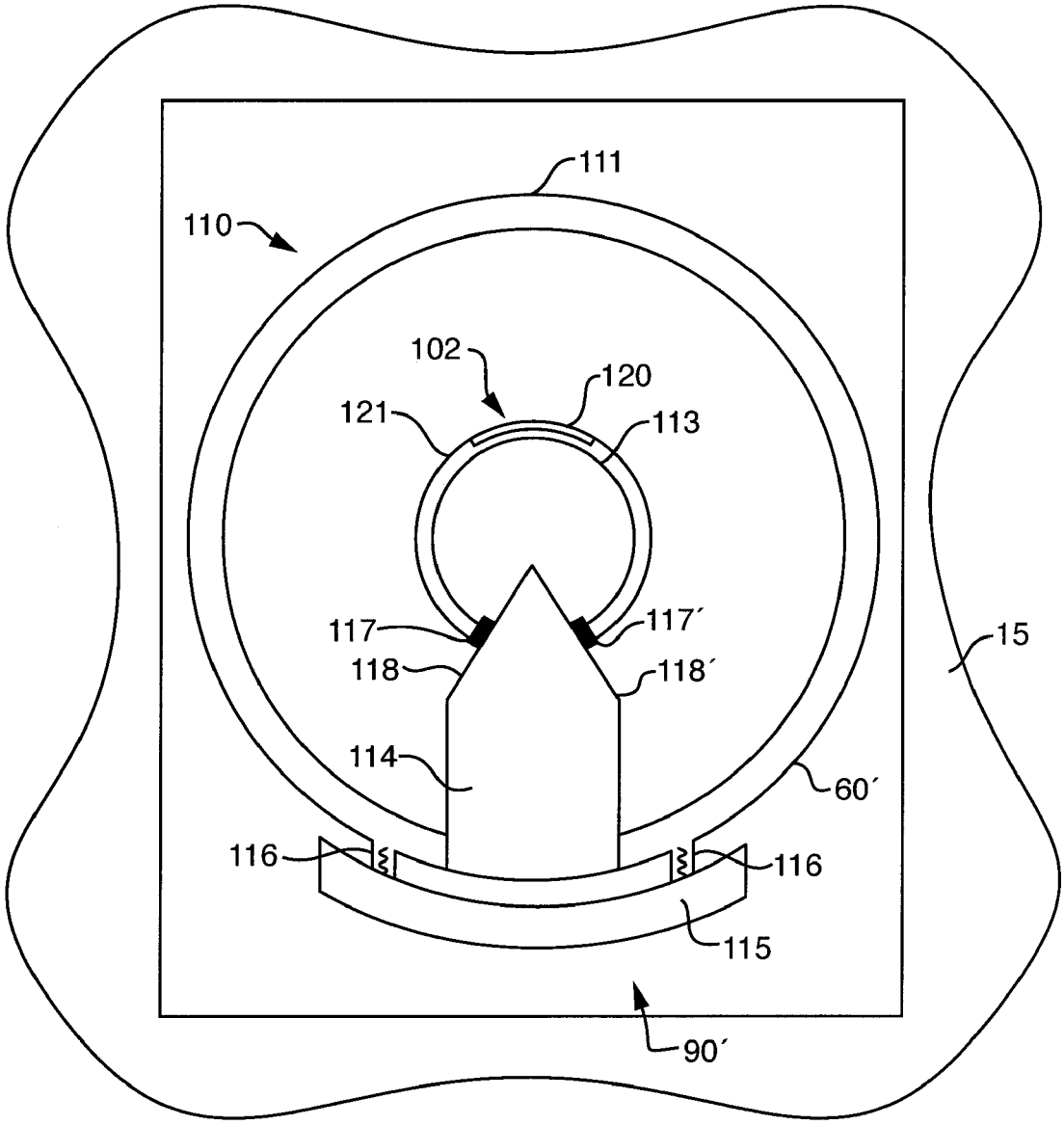
FIG. 8 is a top view of the electrode connection system of the second arrangement of the first embodiment of the present invention showing the first connecting member attached to the substrate.

A second arrangement of the first embodiment of the invention is shown in FIGS. 7-10. Referring to FIGS. 7 and 8, a first connecting member 110 of the electrode connection system 10' includes a base member 111 having opening 112. The member 110 further includes a loop 113, and a loop flexing device. The loop flexing device includes a movable body 114, a press pad 115, one or more springs 116, and loop resistance member 120. The loop 113 is contained within the opening 112 and is attached to the body 114. As an example of how the loop 113 may be attached to the body 114, the loop 113 may have two crimped ends 117/117', and one of the crimped ends 117 may be attached to one of two sloped side walls 118 of the body 114, and the other crimped end 117' may be attached to the other sloped side wall 118'. The loop resistance member 120 is connected to inner wall 121 of the base member 111 essentially at position 122. The member 110 protrudes through a substrate attachment device 90 such that substrate contact face 119 is essentially flush with attachment surface 92. Alternatively, the member 110 may rest entirely on the substrate attachment device 90 and not protrude therethrough, provided there is minimal loss of electrical connectivity with the substrate 15.

Figure 9:
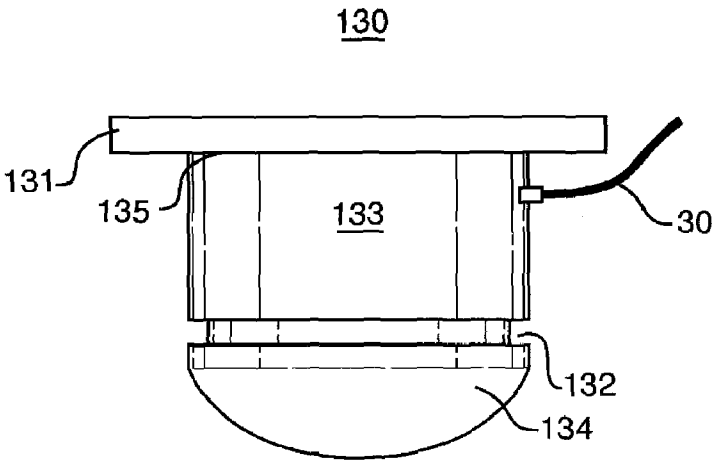
FIG. 9 is a side view of the electrode connection system of the second arrangement of the first embodiment of the present invention showing the second connecting member connected to the electrode wire.

As shown in FIG. 9, a second connecting member 130, which is an electrode, arranged to join with the first connecting member 110, includes a cap 131, and a retaining groove 132. The retaining groove 132 is recessed in outer surface 133, and runs around the entire circumference of outer surface 133 between first end 134 and second end 135 of the body of the second connecting member 130.

Figure 10:
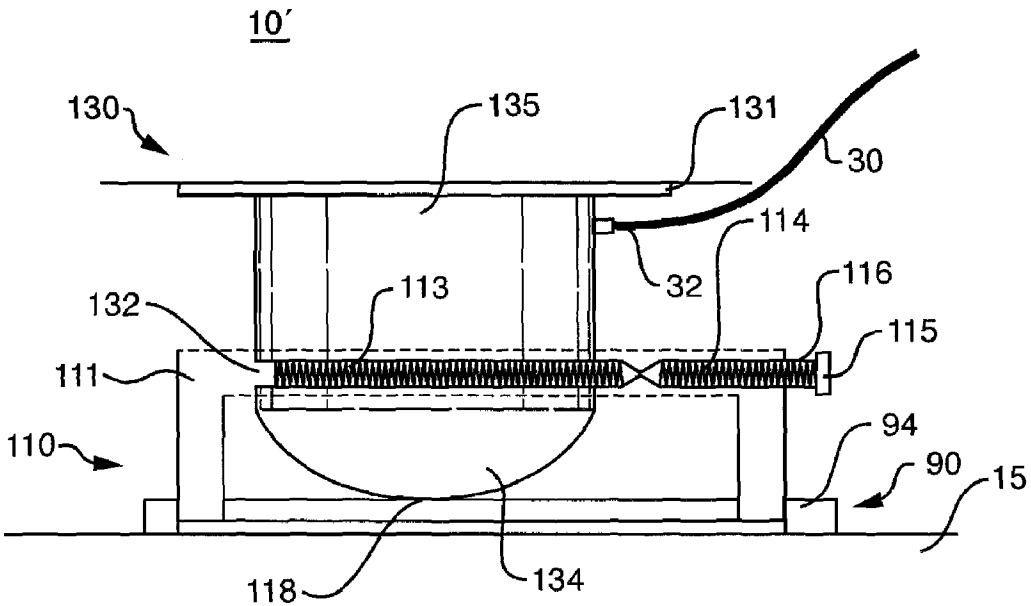
FIG. 10 is a side view of the electrode connection system of the second arrangement of the first embodiment of the present invention showing the first and second connecting members connected to each other.

FIG. 10 shows the first connecting member 110 and the second connecting member 130 connected to each other. Further, first end 32 of the electrode wire 30 is shown as being connected to the second connecting member 130. The second end 34 of the electrode wire 30 is connectable to the monitoring device 40 or the transmitting device 45 as previously described.

Connection of the first connecting member 110 and the second connecting member 130 involves inserting the loop 113 into the retaining groove 132 of the first connecting member 110 as shown in FIG. 10. This insertion may be partially effected by using the press pad 115. When no pressure is applied to the press pad 115, the loop 113 remains in a "resting" state. When the press pad 115 is pressed toward the base member 111, the movable body 114 is moved toward the center of the loop 113 and is pressed against the loop resistance member 120. Whenever the loop 113 is pressed against the loop resistance member 120, the loop 113 changes shape from its resting state to a "widened" state. Subsequent release of the press pad 115 causes the loop 113 to return to its resting state. Retaining the loop 113 within the retaining groove 132 therefore involves forcing the loop 113 to its widened state by pressing the press pad 115, placing the loop 113 around the member 130, inserting the loop 113 within the groove 132, and fully releasing the press pad 115 to return the loop 113 to its resting state. When the loop 113 is secured in its resting state within the groove 132, the loop 113 cannot be removed from the groove 132 without first bringing the loop 113 to its widened state by taking the affirmative steps of pushing the press pad 115 in and moving the loop 113 out of the groove 132.

Alternatively, instead of being connected to the second connecting member 130, the first connecting member 110 may be connected to the coupling device used in the existing electrode connection systems. Further, instead of being connected to the first connecting member 110, the second member 130 may be connected to any existing compatible connecting member used in the art of electrode connection systems. For example, the first connecting member 110 may be connected to the nipple-like member used in existing electrode connection systems.

Figure 11:
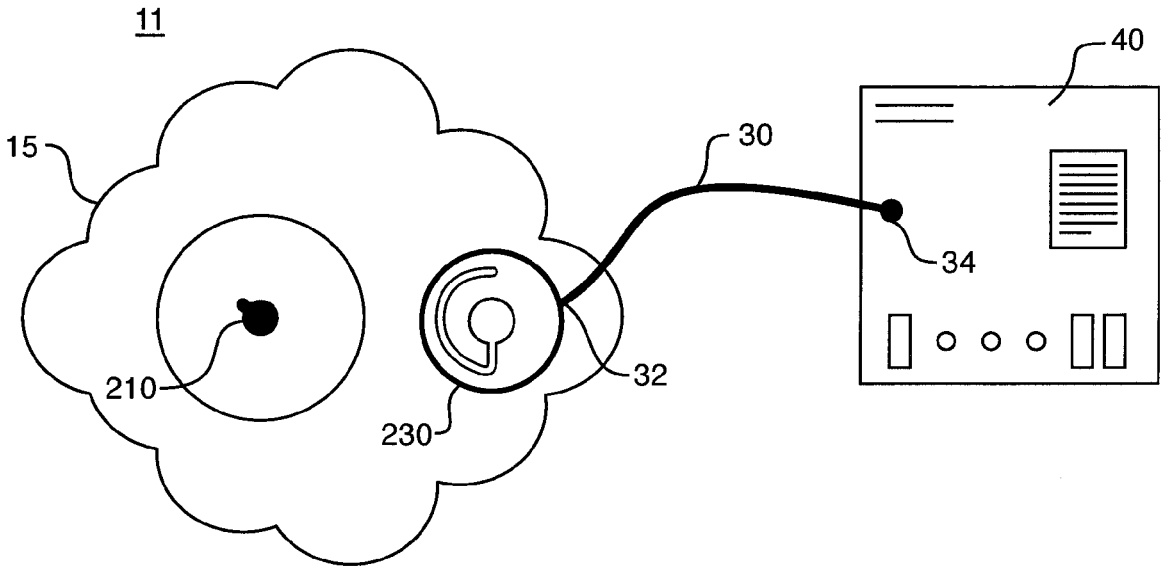
FIG. 11 is a top view of the electrode connection system of a first arrangement of a second embodiment of the present invention showing a first connecting member connected to an electrode wire and a second connecting member attached to a substrate, wherein the connecting members are not connected to each other.
Figure 12:
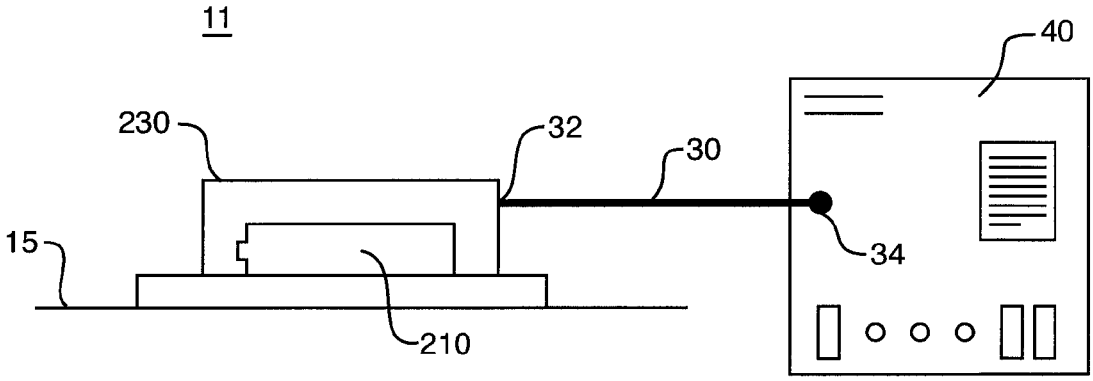
FIG. 12 is a side sectional view of the electrode connection system of the first arrangement of the second embodiment of the present invention showing the first connecting member connected to the electrode wire and the second connecting member attached to the substrate, wherein the connecting members are connected to each other, and therefore, wherein the second connecting member is electrically connected to the substrate.

A first arrangement of a second embodiment of the electrode connection system 11 of the present invention is shown in FIGS. 11-17. In FIG. 11, first connecting member 210 of the system 11 is shown as being disconnected from second connecting member 230. In FIG. 12, the first connecting member 210 and the second connecting member 230 are connected to each other. The same set of connections to the electrode 30 and the monitoring device 40 as previously described are also shown. It is to be noted that the electrode connection system 11 may also be connected to the optional transmitting device of FIG. 2.

Figure 13:
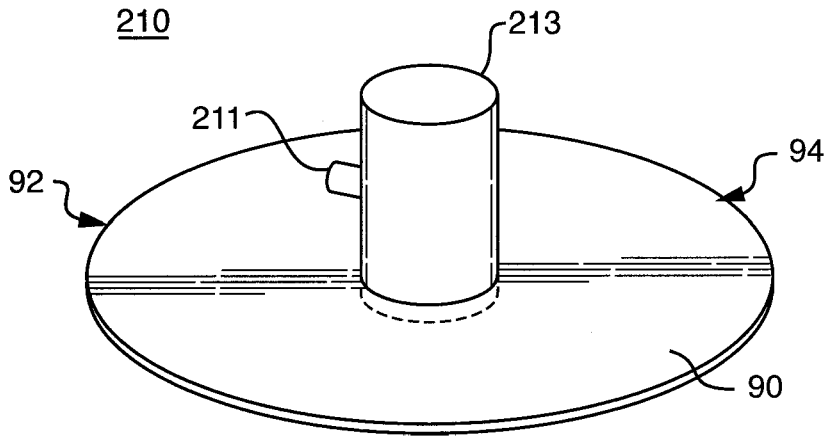
FIG. 13 is a perspective view of the first connecting member of the electrode connection system of the first arrangement of the second embodiment of the present invention.
Figure 14:
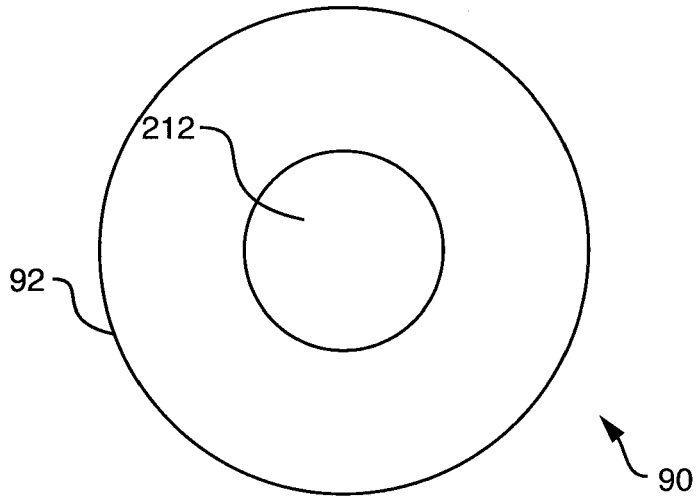
FIG. 14 is a bottom view of the first connecting member of the electrode connection system of the first arrangement of the second embodiment of the present invention.

As shown in FIGS. 13 and 14, in the first arrangement of the second embodiment of the present invention, first connecting member 210 includes a nub 211 which is connected to a substrate attachment device 90, which has attachment surface 92 and non-attachment surface 94. The nub 211 protrudes through the substrate attachment device 90 such that substrate contact face 212 of the member 210 is essentially flush with attachment surface 92, and first end 213 of the member 210 is spaced away from non-attachment surface 94. Alternatively, the member 210 may rest entirely on the substrate attachment device 90 and not protrude therethrough, provided there is minimal loss of electrical connectivity with the substrate 15.

Figure 15:
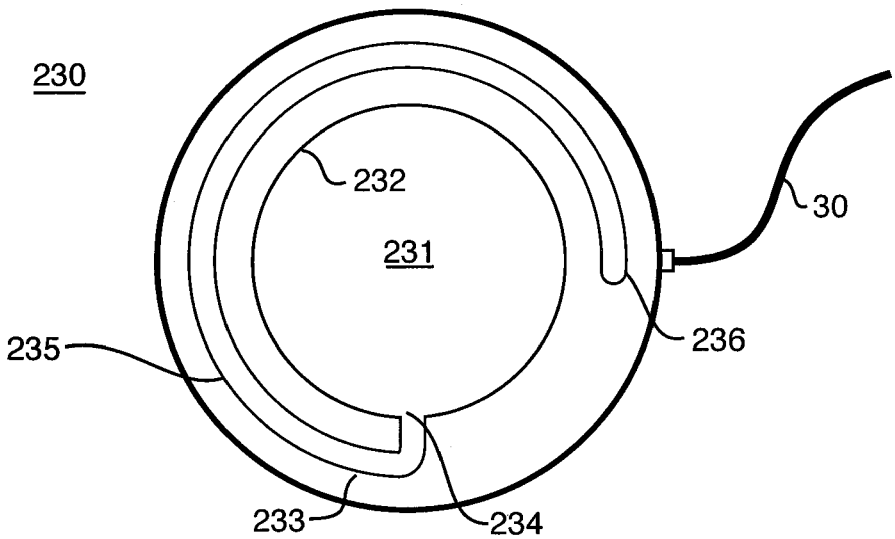
FIG. 15 is a bottom view of the second connecting member of the electrode connection system of the first arrangement of the second embodiment of the present invention.

As shown in FIG. 15, second connecting member 230 includes connection port 231. An inner wall 232 of the second connecting member 230, which faces toward the center of the connection port 231, includes a locking groove 233 having base opening 234, tract 235, and nub retaining basin 236.

Figure 16A:
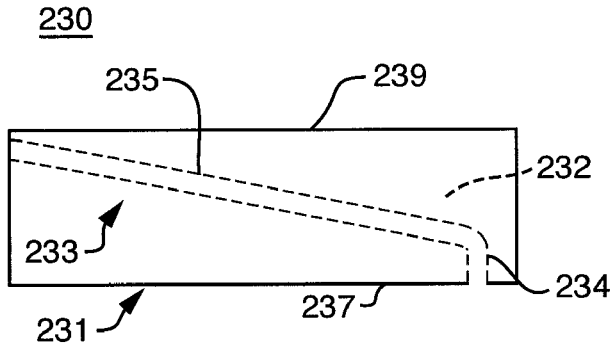
FIG. 16A is a first side view of the second connecting member of the electrode connection system of the first arrangement of the second embodiment of the present invention showing a locking groove of the second connecting member in phantom.
Figure 16B:
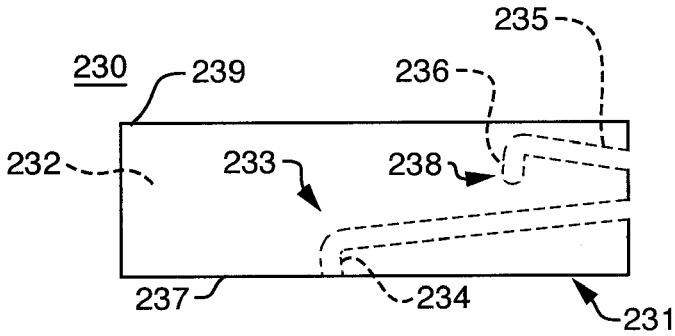
FIG. 16B is a second side view of the second connecting member of the electrode connection system of the first arrangement of the second embodiment of the present invention showing a nub holding basin of the locking groove in phantom at a first location.

As shown in FIGS. 16A and 16B, the locking groove 233 optionally begins at base region 237 of the connection port 231 and run continuously in a spiral manner within the inner wall 232 before ending at position 238, which is near crown 239 of the second connecting member 230. Base opening 234 is at a first end of the locking groove 233 at base region 237, and the nub retaining basin 236 is at a second end of the locking groove 233 which is at position 238. Therefore, in this optional arrangement, base opening 234 and the nub retaining basin 236 are on substantially different planes within the inner wall 232.

Figure 17:
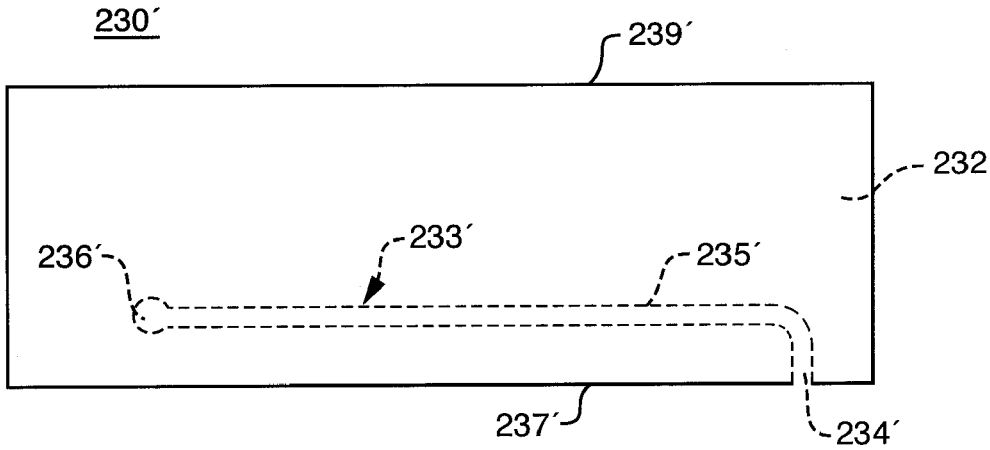
FIG. 17 is a side view of the second connecting member of the electrode connection system of the first arrangement of the second embodiment of the present invention showing the nub holding basin of the locking groove in phantom at a second location.

Alternatively, as shown in FIG. 17, base opening 234' and the nub retaining basin 236' are located on substantially the same plane within inner wall 232' of second connecting member 230', such that all regions of the locking groove 233' are located substantially on the same plane within inner wall 232'.

The first connecting member 210 may be connected to the second connecting member 230' by first inserting the nub 211 into base opening 234' of the second connecting member 230'. Once the nub 211 is inserted into base opening 234', the nub 211 may be slid in two directions along the tract 235' of the locking groove 233' by rotating the second connecting member 230'. To securely hold the nub 211 within the locking groove 233' such as to prevent it from sliding along the tract 235', the nub 211 is slid until it rests within the nub retaining basin 236'. When the nub 211 is held in the nub retaining basin 236', the first connecting member 210 and the second connecting member 230' are effectively securely connected to each other, as shown in FIG. 12.

When the first connecting member 210 and the second connecting member 230' are securely connected to each other, they may be disconnected from each other by first removing the nub 211 from the nub retaining basin 236'. Removal of the nub 211 from the nub retaining basin 236' specifically may be effected by slightly pressuring the crown 239' of the second connecting member 230' in a direction toward the first connecting member 210 while simultaneously rotating the second connecting member 230' until the nub 211 enters the tract 235' of the locking groove 233'. Once in the tract 235', the nub 211 may be slid until it enters the opening 234' of the locking groove 233'. Once in opening 234', the nub 211 may be released from the locking groove 233' altogether by pulling the second connecting member 230' in a direction away from the first connecting member 210.

Figure 19A:
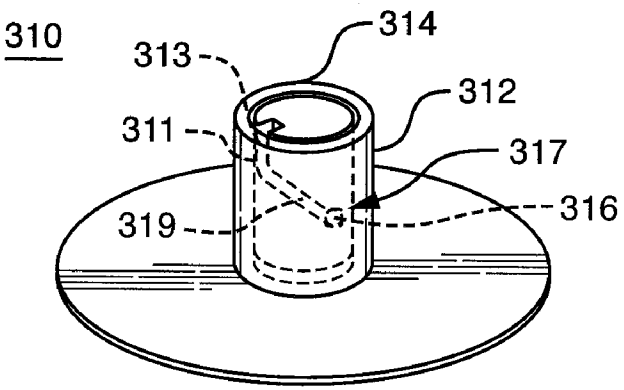
FIG. 19A is a perspective view of a first connecting member of the electrode connection system of the second arrangement of the second embodiment of the present invention showing a nub holding basin of a locking groove of the first connecting member in phantom at a first location.
Figure 20:
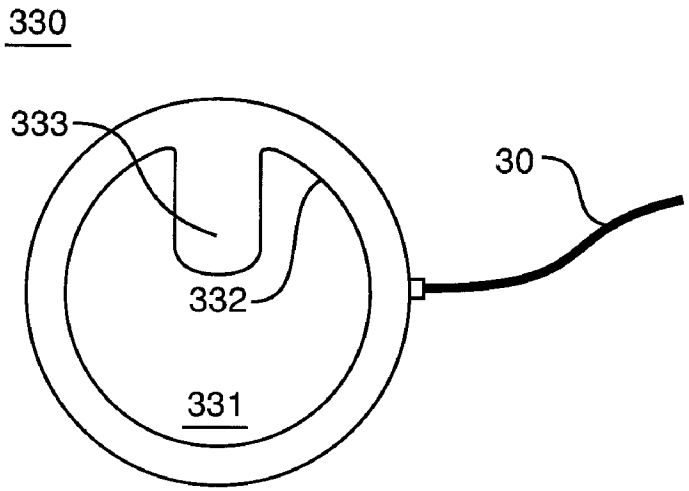
FIG. 20 is a bottom view of the second connecting member of the electrode connection system of the second arrangement of the second embodiment of the present invention.
Figure 18:
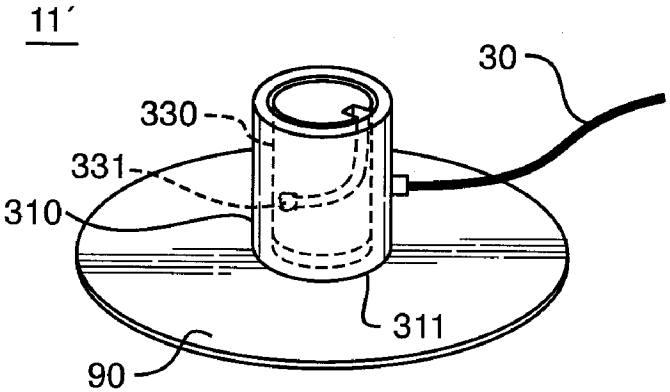
FIG. 18 is a perspective view of the electrode connection system of a second arrangement of the second embodiment of the present invention showing the first and second connecting members connected to each other.

A second arrangement of the second embodiment of the system 11' of the present invention is shown in FIGS. 18-20. In FIG. 18, a first connecting member 310 includes locking groove 311 and a second connecting member 330 includes nub 331 insertable in locking groove 311. Specifically, as shown in FIG. 19A, the locking groove 311 runs continuously along side surface 312 of the first connecting member 310. Crown opening 313 of the locking groove 311 is located at crown 314, and a nub retaining basin 316 optionally is located at region 317 on side surface 312. In this arrangement, the crown opening 313 and the nub retaining basin 316 are located on different planes.

Figure 19B:
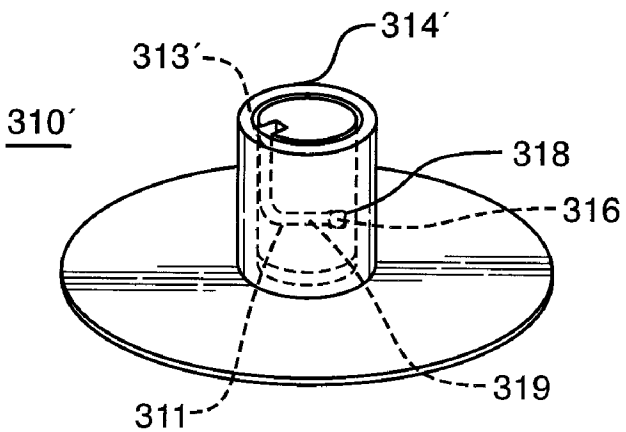
FIG. 19B is a perspective view of the first connecting member of the electrode connection system of the second arrangement of the second embodiment of the present invention showing the nub holding basin of the locking groove in phantom at a second location.

Alternatively, an optional first connecting member 310', as shown in FIG. 19B, includes a crown opening 313' located at crown 314', and a nub retaining basin 316' located near position 318'. The crown opening 313' and the nub retaining basin 316' are of an arrangement such that groove 311' remains substantially in a constant plane.

As shown in FIG. 20, the second connecting member 330 includes a connection port 331 and inner wall 332. Nub 333 is located on the inner wall 332 and faces the center of the connection port 331.

In system 11' of the present invention, the first connecting member 310/310' may be connected to the second connecting member 330 by first inserting the nub 333 into crown opening 313'. Once the nub 333 is inserted into crown opening 313/313', the nub 333 may be slid in two directions within the locking groove 311' by rotating the second connecting member 330. To securely hold the nub 333 within the locking groove 311/311' such as to prevent it from sliding along tract 319/319' of the groove 311/311', the nub 333 is slid until it rests within the nub retaining basin 316/316'. When the nub 333 is held in the nub retaining basin 316/316', the first connecting member 310/310' and the second connecting member 330 are effectively securely connected to each other, as shown in FIG. 18.

When the first connecting member 310/310' and the second connecting member 330 are securely connected to each other, they may be disconnected from each other by first removing the nub 333 from the nub retaining basin 316/316'. Removal of the nub 333 from the nub retaining basin 316/316' specifically may be effected by slightly pressuring the second connecting member 330 in a direction toward the first connecting member 310/310' while simultaneously rotating the second connecting member 330 until the nub 333 enters the tract 319/319' of the locking groove 311/311'. Once in the tract 319/319', the nub 333 may be slid until it enters crown opening 313/313'. Once in the opening 313/313', the nub 333 may be released from the locking groove 311/311' altogether by pulling the second connecting member 330 in a direction away from the first connecting member 310/310'.

A number of examples to help illustrate the invention have been described. Nevertheless, it will be understood that various modifications may be made without departing from the spirit and scope of the invention. Accordingly, other embodiments are within the scope of the claims appended hereto.

What is claimed is:

1. An electrode connection system for connecting an electrode wire to a substrate, the system comprising:
   a. a first connecting member including a retaining groove;
   b. a second connecting member including a loop and a loop flexing device, wherein the electrode wire is connectable to the second connecting member and the loop is arranged for reversible insertion into the retaining groove of the first connecting member; and
   c. a cap, a press pad, one or more springs connected to the cap and press pad, and a loop resistance member, wherein exerting force on the press pad causes movement of the loop toward the loop resistance member until contacting it to change the shape of the loop for placement onto the first connecting member.

2. The electrode connection system of claim 1 wherein the electrode wire is connectable to a monitoring device, and the monitoring device is capable of receiving one or more electrical signals from the substrate.

3. The electrode connection system of claim 1 wherein the first connecting member is joined to a substrate attachment device.

4. An electrode connection system for connecting an electrode wire to a substrate, the system comprising:
   a. a first connecting member including a loop and a loop flexing device;
   b. a second connecting member including a retaining groove, wherein the loop may be reversibly retained within the retaining groove, and wherein the electrode wire is connectable to the second connecting member; and
   c. a cap, a press pad, one or more springs connected to the cap and press pad, and a loop resistance member, wherein exerting force on the press pad causes movement of the loop toward the loop resistance member until contacting it to change the shape of the loop for placement onto the second connecting member.

5. The electrode connection system of claim 4 wherein the electrode wire is connectable to a monitoring device, and the monitoring device is capable of receiving one or more electrical signals from the substrate.

6. The electrode connection system of claim 4 wherein the first connecting member is joined to a substrate attachment device.

7. A connecting member for connecting an electrode wire to a nipple-like member placeable on a substrate, the connecting member comprising: a loop and a loop flexing device, wherein the connecting member is connectable to the nipple-like member and the loop is connectable to the electrode wire, and wherein the loop flexing device includes a cap, a press pad, one or more springs connected to the cap and press pad, and a loop resistance member, wherein exerting force on the press pad causes movement of the loop toward the loop resistance member until contacting it to change the shape of the loop.

* * * * *